US005943541A

United States Patent [19]

Amamiya et al.

[11] Patent Number: 5,943,541

[45] Date of Patent: Aug. 24, 1999

[54] IMAGE FORMING APPARATUS WITH EXTENDED LENGTH CHARGE TRANSPORTING LAYER

[75] Inventors: Shoji Amamiya, Numazu; Noboru Kashimura, Shizuoka-ken, both of Japan

[73] Assignee: Canon Kabushiki Kaisha, Tokyo, Japan

[21] Appl. No.: 08/996,271

[22] Filed: Dec. 22, 1997

[30] Foreign Application Priority Data

Dec. 26, 1996 [JP] Japan ..... 8-348750
Nov. 21, 1997 [JP] Japan ..... 9-321119

[51] Int. Cl.[6] ..... G03G 15/16

[52] U.S. Cl. ..... 399/308; 399/116; 399/302

[58] Field of Search ..... 399/308, 302, 399/297, 116, 121, 159; 347/103; 430/56–58, 60

[56] References Cited

U.S. PATENT DOCUMENTS 5,557,392 9/1996 Iwata ..... 399/223

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

A toner image formed on a photosensitive drum is transferred on to an intermediate transfer member, and then, from the intermediate member onto a sheet material. The forming width of charge transporting layer of this photosensitive drum (forming width along the longitudinal direction of the photosensitive drum) is longer by more than 4 mm (2 mm each at the both ends) than the width of the intermediate transfer member. As a result, no image blur occurs in the transferred images even when repeating formation of a transferred image onto the intermediate transfer member and formation of the transferred image onto the sheet material.

22 Claims, 5 Drawing Sheets

FIG. 3

| | | ELECTROSTATIC CAPACITY ($PF/cm^2$) | PHOTOSENSITIVE LAYER END | DISTANCE FROM INTERMEDIATE COPY END | INITIAL IMAGE | IMAGE AFTER HOLDING |
|---|---|---|---|---|---|---|
| EXAMPLE 1 | | 270 | CHARGE TRANSFER LAYER | 2mm | ○ | ○ |
| EXAMPLE 2 | | 270 | CHARGE TRANSFER LAYER | 3mm | ○ | ○ |
| COMPARATIVE EXAMPLE 1 | | 270 | CHARGE TRANSFER LAYER | 1mm | ○ | × |
| COMPARATIVE EXAMPLE 2 | | 21600 | UNDERCOAT LAYER | 2mm | △ | × |
| COMPARATIVE EXAMPLE 3 | | 57600 | CHARGE GENERATING LAYER | 2mm | △ | × |
| EXAMPLE 3 | WITH TEFLON | 280 | CHARGE TRANSFER LAYER | 2mm | ○ | ○ |
| | WITHOUT TEFLON | 270 | CHARGE TRANSFER LAYER | 2mm | ○ | ○△ |

○ : NO IMAGE BLURS OCCUR

○△ : SLIGHT IMAGE BLURS IN 2 OF 10

△ : SLIGHT IMAGE BLURS IN ALL SAMPLES

× : IMAGE BLURS IN ALL SAMPLES

IMAGE FORMING APPARATUS WITH EXTENDED LENGTH CHARGE TRANSPORTING LAYER

BACKGROUND OF THE INVENTION

1. Field of the Invention

The present invention relates to an image forming apparatus which transfers a toner image on an image bearing member onto an intermediate transfer member, and transfers the toner image on this intermediate transfer member onto a transfer material.

2. Description of the Related Art

Various electrophotographic image forming apparatuses have conventionally been proposed. FIG. 1 illustrates an entire configuration of a conventional electrophotographic image forming apparatus. This image forming apparatus G1 has a photosensitive drum 1 which is rotatably supported and rotation-driven in the arrow direction. On the outer periphery of the photosensitive drum 1, there are arranged a primary charger 2 which charges uniformly the surface of the drum, exposing means 3 such as a laser beam exposure unit which forms an electrostatic latent image on the drum surface by irradiating a color-separated optical image or one corresponding thereto, a developing device 5 which converts the forgoing electrostatic latent image into a visible image (toner image), an intermediate transfer member 6 onto which the toner image is transferred under the pressure of the photosensitive drum, and a cleaner 7 which removes toner remaining on the drum surface.

The intermediate transfer member 6 has a layer structure as shown in FIG. 4B: a conductive layer 12 and a surface layer 13 onto which the toner image is transferred are provided on a conductive substrate 11. When transferring the toner image present on the photosensitive drum 1 onto the intermediate transfer member 6, a prescribed bias is applied by a power supply 21 onto the substrate 11.

A convey belt 9 for conveying a sheet material P so as to be in contact with the intermediate transfer member 6 is arranged below the intermediate transfer member 6, and a fig device 8 for performing fixing of the toner image is arranged downstream of the convey belt 9.

Now, operations of the aforesaid image forming apparatus will be briefly described below.

When the primary charger 2 is operated in a state in which the photosensitive drum 1 is rotation-driven, the surface of the drum is uniformly charged. When the exposing means 3 irradiates an optical image, an electrostatic latent image is formed on the drum surface, and this electrostatic latent image is converted into a visible image by the developing device 5. Then, the visible image Is transferred onto the intermediate transfer member 6.

In the meantime, the sheet material P is transferred by the convey belt 9, and the toner image on the intermediate transfer member 6 is transferred onto the sheet material P by a transfer roller 20. Thereafter, the sheet material P is sent to the fixing device 8 for fixing of the toner image, and is discharged to outside the apparatus.

The toner remaining on the surface of the photosensitive drum 1 is, on the other hand, removed by the cleaner 7, and the photosensitive drum 1 is now ready for the next image forming process.

The photosensitive drum 1 has a conductive substrate made of a metal or the like and a photosensitive layer formed on the surface of the substrate. An intermediate layer such as an adhering layer or a conductive Layer may be provided between the conductive substrate and the photosensitive layer. These layers including an intermediate layer, if any, are hereinafter referred to as the photosensitive layer The photosensitive layer of the photosensitive drum 1 has a longitudinal length substantially equal to the longitudinal length of the intermediate transfer member 6.

In the foregoing image forming apparatus, a problem is encountered in that discharge (electric stress) occurs at the both ends of the region where the photosensitive drum 1 comes into contact with the intermediate transfer member 6, thus leading to image blurs in a transfer image of the intermediate transfer member 6 or that on the sheet material P.

An organic resin is commonly used for the photosensitive layer for various reasons (cost reduction, wide selection of materials, for example). The aforesaid problem is more apparent since an organic resin has poor mechanical strength and is easily susceptible of resin deterioration caused by discharges.

SUMMARY OF THE INVENTION

An object of the present invention is therefore to provide an image forming apparatus which permits prevention of occurrence of disturbance to a toner image to be transferred from the image bearing member to an intermediate transfer member, i.e., occurrence of image blurs.

BRIEF DESCRIPTION OF THE DRAWINGS

FIG. 3 illustrates effects of the examples and the comparative examples;

DETAILED DESCRIPTION OF THE PREFERRED EMBODIMENTS

Figure 1:
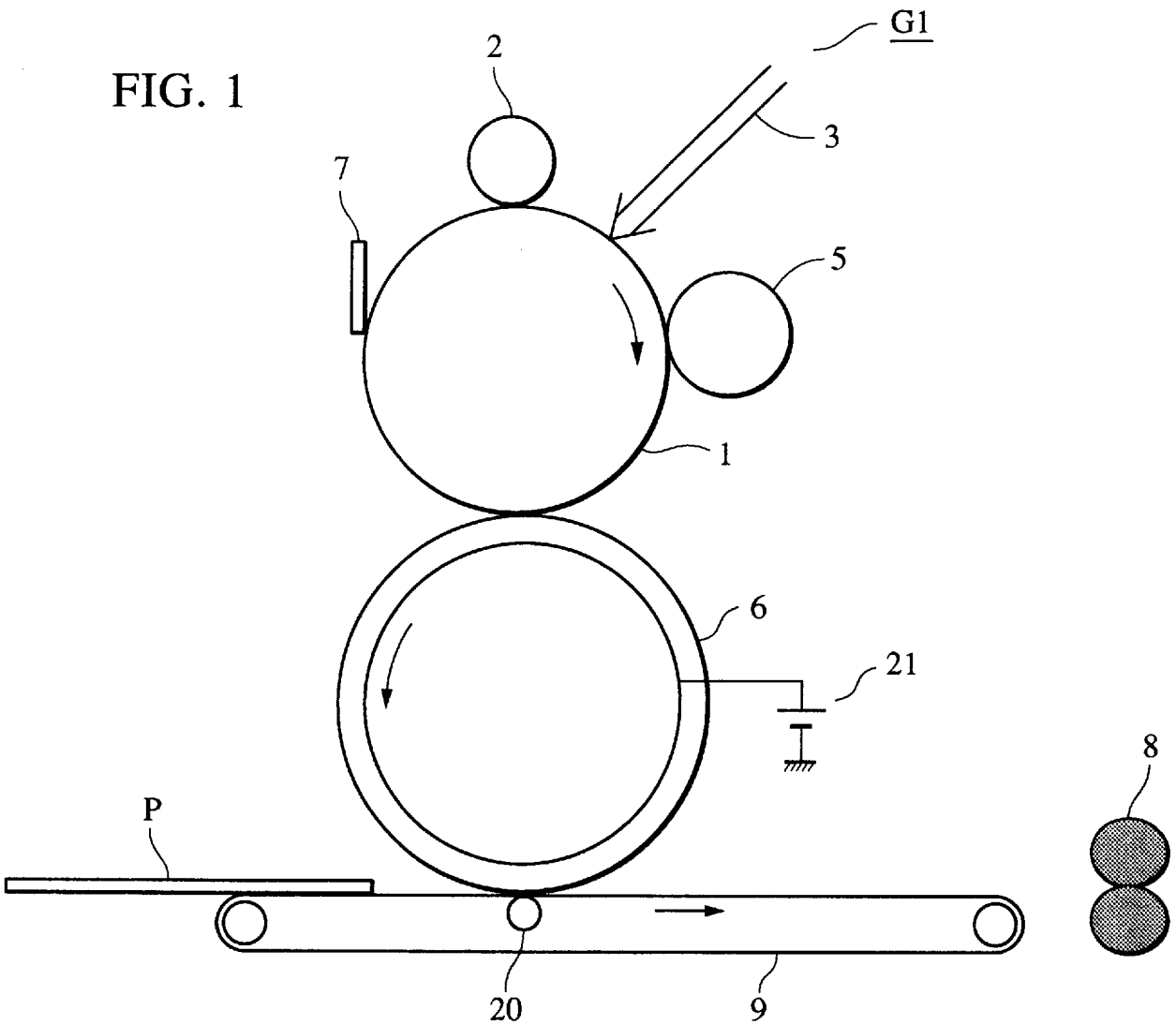
FIG. 1 illustrates an entire configuration of an electrophotographic image forming apparatus.

Now, embodiments of the present invention will be described below with reference to FIGS. 2 to 5. The parts corresponding to those shown in FIG. 1 are assigned the same reference numerals, and the description thereof is omitted.

The image forming apparatus of this embodiment has the same configuration as the image forming apparatus G1 shown in FIG. 1 except for a different configuration of the photosensitive drum.

More specifically, the image forming apparatus of this embodiment has a photosensitive drum 10 serving as an image bearing member, rotatably supported and rotation-driven, and on the outer periphery of the photosensitive drum 10, there are arranged a primary charger 2 and exposing means 3 serving as latent image forming means, a developing device (developing means) 5, an intermediate transfer member 6 and a cleaner 7. A convey belt 9 for conveying a sheet material P serving as a transfer material is arranged below the intermediate transfer member 6, and a fixing device 8 is arranged downstream of the convey belt 9.

Now, the configuration of the photosensitive drum 10 will be described.

Figure 4A:
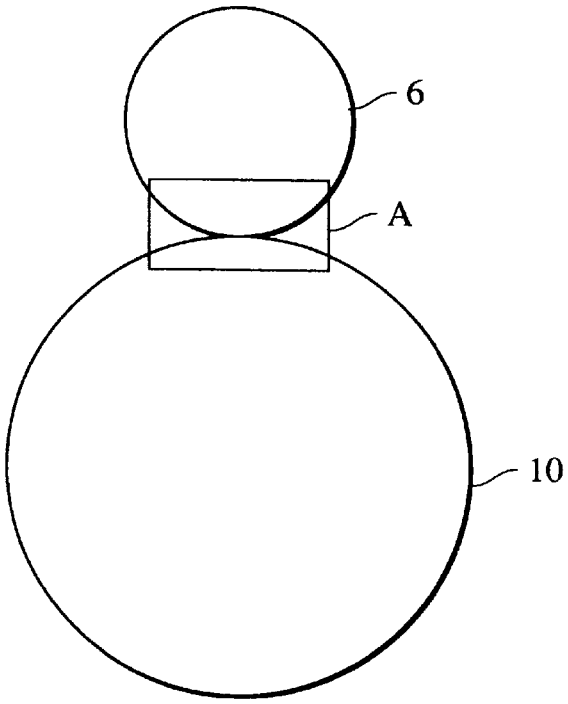
FIGS. 4A and 4B illustrate the layer structures of the intermediate transfer member and the image bearing member.
Figure 4B:
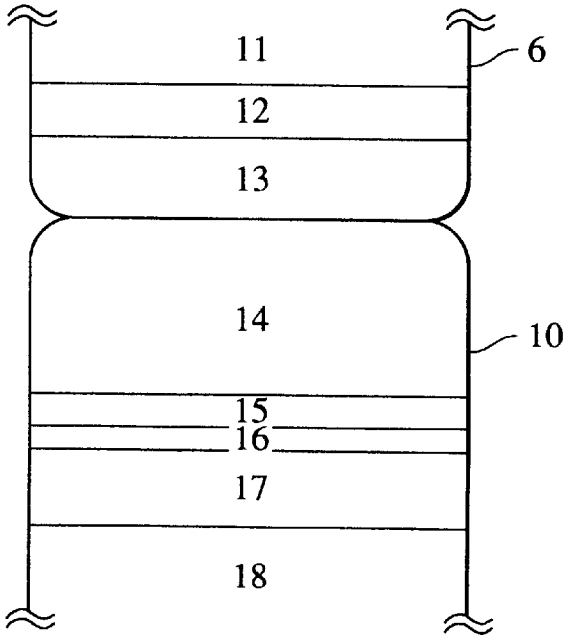

The photosensitive drum 10 has, as shown in FIG. 4B, a rotation-driven cylindrical conductive substrate 18, and a photosensitive layer comprising a plurality of coated layers is formed on the substrate 18 surface. FIG. 4A represents the photosensitive drum 10 and the intermediate transfer member 6 as viewed from the rotation axis direction, and FIG. 4B is an enlarged schematic view of a contact portion A.

The photosensitive layer may be formed by laminating a charge generating layer 15 generating a charge carrier and a charge transporting layer 14 having ability to transfer the generated charge carrier, thus permitting improvement of properties.

An intermediate layer may be provided between the conductive substrate 18 and the charge generating layer 15. This makes it possible to improve adhesion between the conductive substrate 18 and the photosensitive layer, increase paintability of the photosensitive layer, protect the conductive substrate 18, cover surface defects of the conductive substrate, protect the photosensitive layer from electric destruction, or improve charge injectability from the conductive substrate into the photosensitive layer.

Further, a protective layer may be formed on the surface of the charge transporting layer 14.

Figure 2:
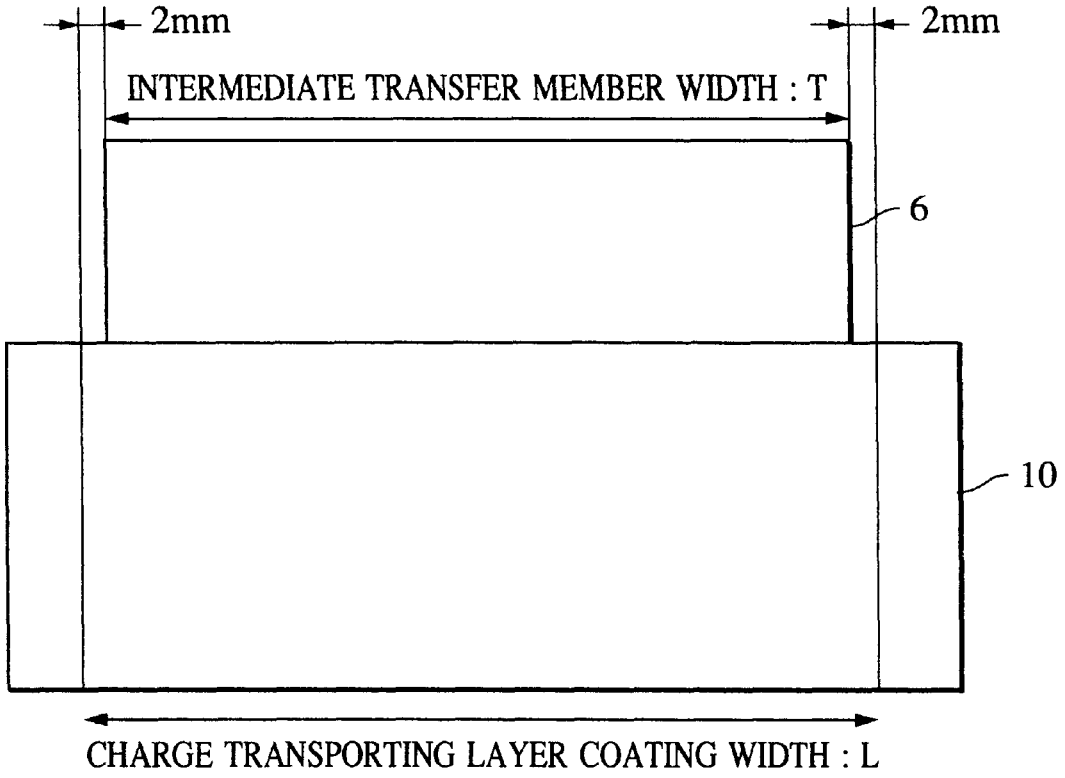
FIG. 2 illustrates the relationship between the width of the intermediate transfer member and the width of the charge transporting layer of the image bearing member.

In this embodiment of the invention, as shown in FIG. 2, the forming width L of the charge transporting layer having the smallest electrostatic capacity among the plurality of coated layers (forming width in the longitudinal direction along the photosensitive drum 10) is longer by more than 4 mm than the width of the intermediate transfer member T. That is, both ends of the charge transporting layer having the smallest electrostatic capacity project by more than 2 mm, respectively, from the both ends of the intermediate transfer member 6.

The conductive substrate 18 is made of a metal such as aluminum or copper, cardboard, or plastics.

The foregoing photosensitive layer may be formed by vacuum-depositing a material selected from the group consisting of selenium, arsenic selenide, a chalogenide compound such as a selenium-tellurium-arsenic alloy, silicon, germanium, phthalocyanine pigment, and cadmium sulfide, or by depositing silicon or germanium by the CVD method, or further, coating, together with an adhesive resin as required, a dye-sensitized zinc oxide, selenium powder, amorphous silicon powder, polyvinyl carbazole, phthalocyanine pigment or ozadiazole pigment.

When the photosensitive layer has a lamination structure with a charge generating layer 15 and a charge transporting layer 14, and an organic optical conductive layer is used, the charge generating layer 15 may be formed by dispersing a charge generating material (for example, an azo pigment such as Sudan red or Dian blue, a disazo pigment, a quinono pigment such as Algor yellow or pyrene quinone, a quinocyanine pigment, a perylene pigment, an Indigo pigment such as Indigo or thioindigo, a bisbenzoyimidal pigment such as Indo-First orange, a quinacridone pigment, pyrylium salt or azulenium salt) in a bonding resin (for example, polyester, polyvinyl acetate, acryl, polycarbonate, polyarylate, polystyrene, polyvinylbutyral, polyvinylpyrrolidone, methyl cellulose, hydroxypropylmethyl cellulose, or cellulose ether). It may also be formed by vacuum deposition. The charge generating layer 15 should preferably have a thickness within a range of from about 0.05 to 0.2 $\mu$m.

When the photosensitive layer has a lamination structure with a charge generating layer 15 and a charge transporting layer 14, and an inorganic optical conductive layer is used, the charge generating layer 15 may be formed by vacuum-depositing, coating or CVD-depositing selenium, a chalcogenide compound such as arsenic selenide, silicon, germanium or cadmium sulfide. In this case, the charge generating layer 15 should preferably have a thickness within a range of from 0.1 to 10 $\mu$m.

For forming the charge transporting layer 14, there is used a positive hole transporting material (a compound having, in the main chain or the side chain, a polycyclic aromatic structure or a nitrogen-containing cyclic structure such as indole, carbazole, ozadiazole, isozadiazole, thiazole, imidazole, pyrazole, ozadiazole, pyrazoline, thiadiazole, or triazole, or a hydrazone compound) dissolved in a film-formable resin (polycarbonate, polyarylate, polystyrene, polymethacrylic acid esters, styrene, methacrylic acid methyl copolymer, polyester, styrene-acrylonitrile copolymer or polysulfon). The film-formable resin is used because a charge transferring material has in general a low molecular weight and is therefore poor in film-formability in itself. The charge transporting layer 14 should preferably have a thickness within a range of from about 5 to 30 $\mu$m, or more preferably, from 5 to 20 $\mu$m.

The charge transporting layer 14 should preferably have an electrostatic capacity within a range of from 180 to 600 $PF/cm^2$ to prevent insufficient charge of residual charge remaining on the surface of the photosensitive drum 10 after the completion of transfer of the toner image from the photosensitive drum 10 to the intermediate transfer member 6, and to avoid problems in durability.

Both ends of the charge transporting layer 14 project by more than 2 mm, respectively, from both ends of the intermediate transfer member 6.

The foregoing intermediate layer may have a single-layer structure or a lamination structure comprising a conductive layer 17 and an undercoat layer 16.

In the case of the single-layer structure, the intermediate layer may be made of polyvinyl alcohol, polyvinyl methylether, poly-N-vinyl imidazole, ethyl cellulose, methyl cellulose, ethylene-acrylic acid copolymer, casein, gelatine, or polyamide.

In the case of the lamination structure, the conductive layer 17 on the side in contact with the conductive substrate 18 is formed into a relatively large thickness with a view to covering defects, if any, on the surface of the conductive substrate, and an undercoat layer 16 is formed on the surface of this conductive layer 17.

Among others, the conductive layer 17 may be formed, not with a single resin, but with a material containing a conductive substance, so as to reduce the resistance value thereof to prevent occurrence of residual potential. Applicable conductive substances include fine powder of a metal such as aluminum, copper, gold and nickel, and powder of carbon, titanium oxide and tin oxide.

The undercoat layer 16 may be formed with polyvinyl alcohol, polyvinyl methylether, poly-N-vinyl imidazols, ethyl cellulose, methyl cellulose, ethylene-acrylic acid copolymer, casein, gelatins or polyamide.

Now, the configuration of the intermediate transfer member 6 will be described.

The intermediate transfer member 6 has, as shown in FIG. 4B, a rotation-driven cylindrical conductive substrate 11, a conductive layer 12 formed on the surface of the substrate 11, and a surface layer 13 formed on the surface of the conductive layer 12. The substrate 11, the conductive layer 12 and the surface layer 13 have substantially equal longitudinal lengths. The substrate 11 may be made of a metal or a resin. The substrate 11 is not limited to a cylindrical one, but may have a belt-like shape The longitudinal lengths of the substrate 11, the conductive layer 12 and the surface layer 13 may be different. In this case, the length of the intermediate transfer member 6 means the length of the surface layer 13 in contact with the photosensitive drum 10. The surface layer 13 of the intermediate transfer member 6 should preferably have an electrostatic capacity within a range of from 200 to 440 PF/cm$^2$, and in is this embodiment and the subsequent example and comparative examples, a capacity of 220 PF/cm$^2$ is employed.

With a view to reducing frictional force between the photosensitive drum 10 and the intermediate transfer member 6, the surface of the photosensitive drum 10 or the surface of the intermediate transfer member 6 may contain Teflon resin particles (Teflon: commercial product name). The presence of Teflon resin particles permits improvement of strippability relative to the toner and transfer efficiency.

Now, operations of this embodiment of the invention will be described.

The surface of the photosensitive drum 10 is uniformly charged by applying a voltage comprising a DC voltage superposed by an AC voltage onto a primary charger 2 serving as charging means in a state in which the photosensitive drum 10 is rotation-driven. When developing an image by the reversal development method by the use of a negative polarity toner, the surface of the photosensitive drum 10 should preferably have a charged potential within a range of from −350 to −800 V. After the completion of image formation, an AC voltage is applied onto the primary charger 2, thus discharging the surface of the photosensitive drum 10. When an optical image is irradiated from the exposing means 3, an electrostatic latent image is formed on the surface of the drum. This electrostatic latent image is developed by the developing device S into a visible image (toner image). Then, when a prescribed voltage is applied onto the substrate 11 from the power supply 21 serving as voltage applying means, this visible image is transferred onto the intermediate transfer member 6. By sequentially repeating this process of transfer for toners of a plurality of colors, toners of all colors are laminated on an intermediate transfer member 6. At this point, a voltage within a range of from +150 to +400 V is applied from the power supply 21 onto the substrate 11.

In the process of transfer described above, therefore, the potential between the photosensitive drum 10 and the intermediate transfer member 6 is within a range of from about 500 to 1,200 V.

The sheet material P serving as a transfer material is transferred by the convey belt 9, and the toner image on the intermediate transfer member 6 is transferred by the transfer roller 20. Thereafter, the sheet material P is transferred to the fixing device 8 for fixing of the toner image, and then is discharged to outside the apparatus.

After transfer, on the other hand, the toner remaining on the surface of the photosensitive drum 10 is removed by the cleaner 7, and the photosensitive drum 10 is now ready for the next image forming process.

Now, the effects of this embodiment of the invention will be described below.

According to the present embodiment, frictions (mechanical stress) between the photosensitive drum 1 and the intermediate transfer member 6 can be reduced by adding Teflon resin particles, and discharge (electrical stress) between the photosensitive drum 1 and the intermediate transfer member 6 can be avoided by making the forming width of the charge transporting layer 14 longer by more than 2 mm than the width of the intermediate transfer member 6 at both ends thereof. No image blur occurs therefore in these transferred images even when repeating formation of an image transferred onto the intermediate transfer member 6 or formation of an image transferred onto the sheet material P.

An organic resin may therefore be used for the photosensitive layer, thereby reducing the cost.

EXAMPLES

Now, examples of the invention will be described.

Forty bottomed cylindrical conductive substrates 18 were prepared using aluminum as the material for the conductive substrates 18 and in accordance with the squeezing fabrication method as disclosed in Japanese Unexamined Patent Publication No. S59-10,950, and the thus prepared conductive substrates 18 were used for the following examples and comparative examples.

The conductive substrate 18 had a diameter of 47 mm, a thickness of 1.0 mm and a length of 286 mm.

Further, in the following description of the Examples and Comparative Examples, the photosensitive drum 10 has a four-layer structure (sequentially a conductive layer 17, an undercoat layer 16, a charge generating layer 15 and a charge transporting layer 14). Among these four layers, the charge transporting layer 14 has the smallest electrostatic capacity. The electrostatic capacity as used here is a value converted into one per unit area, and can be measured by the following method on the basis of the dielectric constant and the thickness of a layer comprising the mixture of all the materials.

The electrostatic capacity was determined in the invention by the following measurement procedure.

Figure 5:
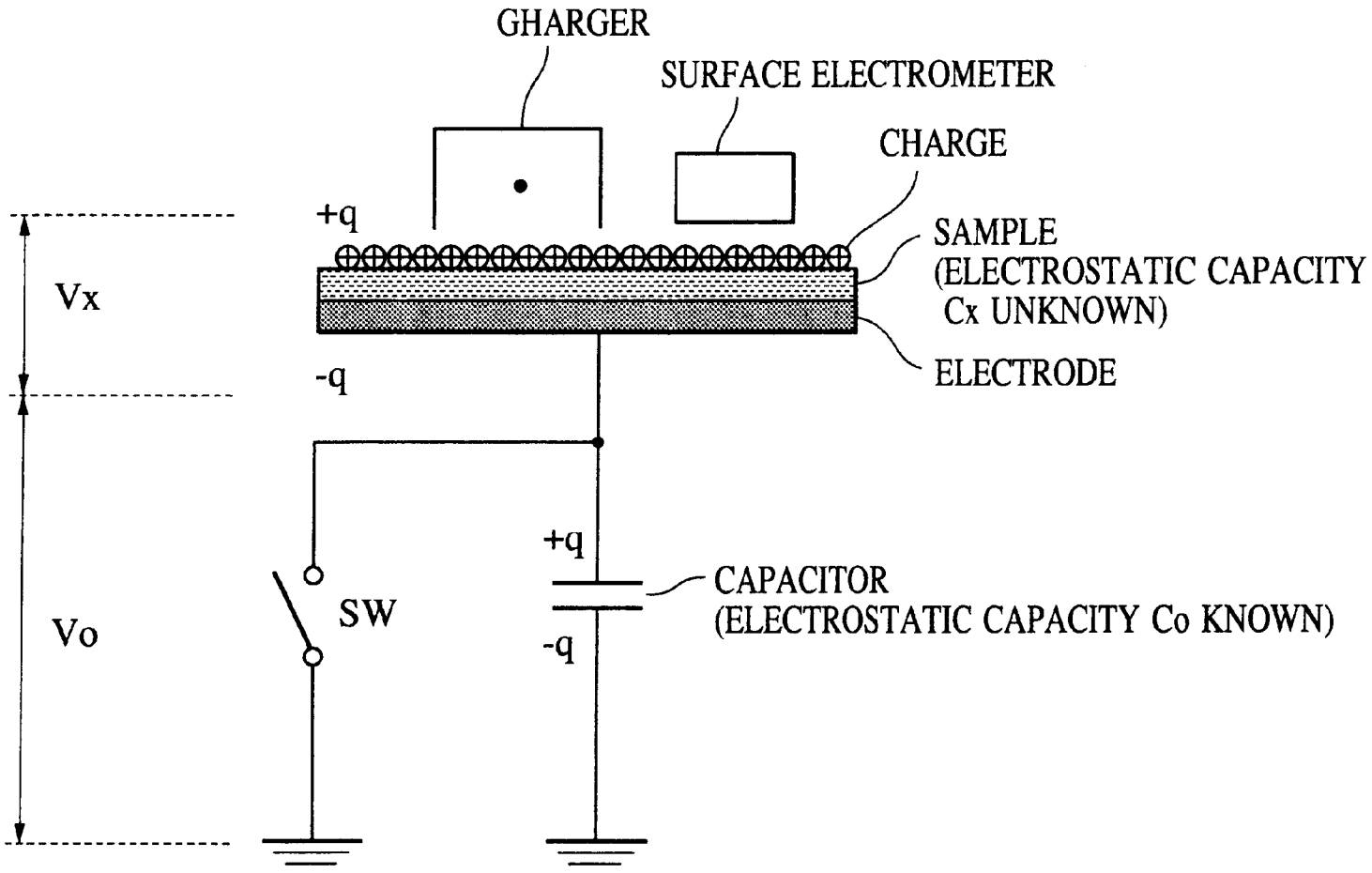
FIG. 5 illustrates the principle of an apparatus for measuring electrostatic capacity.

FIG. 5 is a schematic view of an electrostatic capacity measuring unit, and the measuring method is as described below:

1) A sample of which the electrostatic capacity (Cx) to be measured is connected to a capacitor having a known electrostatic capacity (Co) as shown in FIG. 5, and the sample is charged by means of a corona charger applied with a prescribed DC voltage;

2) Then, the SW is turned off, and the surface potential of the sample is measured with the surface electrometer. The measured value at this point is assumed to be V1; and 3) Then, the SW is turned on, and the surface potential of the sample is measured again with the surface electrometer; the measured value at this point is assumed to be V2.

The electrostatic capacity Cx is calculated as follows:

$$V1=Vo+Vx=q/Co+q/Cx \quad (1)$$

$$V2=Vx=q/Cx \quad (2)$$

By eliminating q from the formulae (1) and (2), the following formula is obtained:

$$Cx=[(V1-V2)/V2]\cdot Co$$

The electrostatic capacity per unit area is determined by dividing the thus measured electrostatic capacity Cx by the sample surface area.

The electrostatic capacity is 21,600 PF/cm$^2$ for the undercoat layer 16, 57,600 PF/cm$^2$ for the charge generating layer 15, and 270 PF/cm$^2$ for the charge transporting layer 14.

In the following description of the Examples and Comparative Examples, the surface of the photosensitive drum 10 is uniformly charged to 1550 V by means of the primary charger 2. The image is developed into a toner image by the developing device 5 (with a developing bias of −300 V). A voltage of +300 V is applied from the power supply 21 serving as voltage applying means onto the substrate 11 of the intermediate transfer member 6, and the toner image is transferred onto the intermediate transfer member 6. A voltage of +1,500 V is applied onto the transfer roller 20, and the toner image is transferred from the intermediate transfer member 6 onto the sheet material P sent on the convey belt 9. The image evaluation test described below was carried out in the Examples and the Comparative Examples under these conditions.

A dispersion solution for the charge generating layer was prepared by dispersing 4 weight parts disazo pigment of the following structural formula, 2 weight parts polyvinyl butyral (butyralizing rate: 68%; weight average molecular weight: 24,000), 34 weight parts cyclohexanon, and glass beads having a particle size of 1 mm in a sand mill for 12 hours, and then adding 200 weight parts cyclohexanone and 200 weight parts tetrahydrofuran (THF). This dispersion solution was dip-coated onto the surface of the undercoat layer 16, and the resultant coat was dried by heating at a temperature of 120° C. for 30 minutes, thereby forming the charge generating layer 15 having a thickness of 0.15 μm.

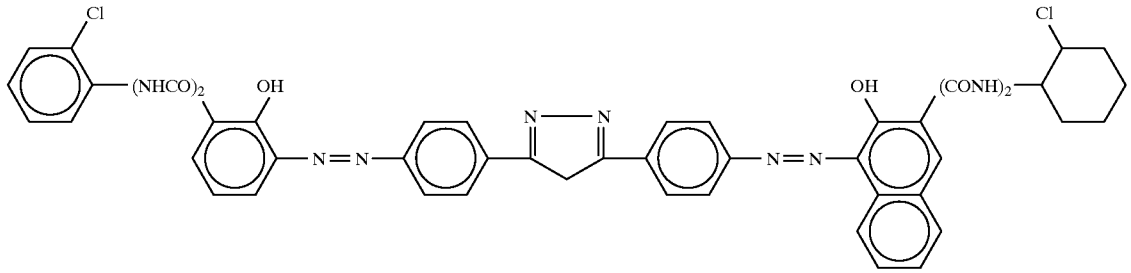

Example 1

In this Example, the forming width L of the charge transporting layer 14 having the smallest electrostatic capacity of 270 PF/cm$^2$ among the photosensitive layers 14 to 17 (forming width along the longitudinal direction of the photosensitive drum 10) is longer by 4 mm than the width T of the intermediate transfer member 6. That is, both ends of the charge transporting layer 14 project by more than 2 mm, respectively, from both ends of the intermediate transfer member 6. The other layers have lengths substantially equal to the width R of the intermediate transfer member 6.

Further, in this example, the photosensitive drum 10 was prepared by the following method.

In forming the conductive layer 17, a conductive paint was first prepared by mixing 10 weight parts titanium oxide powder surface-coated with conductive tin oxide (made by Titan Kogyo Co.) and 10 weight parts titanium oxide powder (made by Sakai Kagaku Co.) with a solution comprising 17 weight parts phenol resin (commercial product name: PRIOPMMN J325, made by Dai-Nihon Ink Co.), 3 weight parts methanol, and 10 weight parts 2-methaxyethanol, and dispersing the resultant mixture on a ball mill.

Then, the thus prepared conductive paint was dip-coated onto the surface of the conductive substrate 18 and heated to a temperature of 140° C. for 20 minutes to form a conductive layer 17 having a thickness of 20 μm. The conductive layer 17 was provided so as to hide slight flaws of the order of several t on the surface of the conductive substrate 18.

A polyamide resin layer (undercoat layer 16) having a thickness of 0.6 μm was formed by preparing a solution by dissolving 4 weight parts copolymer nylon (commercial product name:CM8000, made by Torey Co.) and 4 weight parts type 8 nylon (commercial product name: LACQUAMIDE 5003, made by Dai-Nihon Ink Co.) in 50 weight parts methanol and 50 weight parts n-butanol, and dip-coating the resultant solution onto the surface of the conductive layer 17.

Further, a solution was prepared by dissolving 10 weight parts stytyl compound of the following structural formula and 10 weight parts polycarbonate (weight average molecular weight: 46,000) in a mixed solvent comprising 20 weight parts dichlormethane and 40 weight parts monochlorbenzene, and the resultant solution was dip-coated onto the surface of the charge generating layer 15, and dried at a temperature of 120° C. for 60 minutes, thereby forming the charge transporting layer 14 having a thickness of 20 μm.

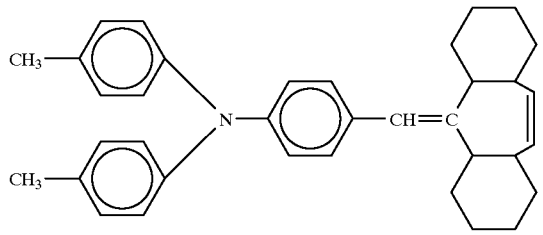

Now, the effects of this Example will be described.

Three photosensitive drums 10 prepared by the foregoing method were attached, respectively, to image forming apparatuses shown in FIG. 1 to make 1,000 copies at room temperature and ambient humidity (20° C., 55%), and the images were evaluated. A cycle (a rotation period of the photosensitive drum) of 1.0 second was used for the image forming process.

According to this embodiments as shown in FIG. 3, all images including not only the initially formed image (initial image) but also even the 1,000th image (image after a long operation) were satisfactory, and no trace of image blur was observed.

Example 2

In this Example, the forming width L (forming width along the longitudinal direction of the photosensitive drum 10 ) of the charge transporting layer 14 having the smallest electrostatic capacity if 270 PF/cm$^2$ among the photosensitive layer 14 to 17 is longer by 6 mm than the width T of the intermediate transfer member 6. That is, both ends of the charge transporting layer 14 project by 3 mm, i.e., more than 2 mm, respectively, from both ends of the intermediate transfer member 6. The other layers have substantially the same length as the width T of the intermediate transfer member 6.

In this Example, the photosensitive drum 10 was prepared in the same manner as in the foregoing Example 1.

Now, the effects of this Example will be described.

Two photosensitive drums 10 prepared by the foregoing method were attached, respectively, to image forming apparatuses shown in FIG. 1 to make 1,000 copies at room temperature and ambient humidity (20° C., 55%), and the images were evaluated. A cycle of 1.0 second was used for the image forming process.

According to this Example, as shown in FIG. 3, all images including not only the initially formed image (initial image) but also even the 1,000th image (image after a long operation) were satisfactory, and no trace of image blur was observed.

Comparative Example 1

In this Comparative Example, the forming width L (forming width along the longitudinal direction of the photosensitive drum 10) of the charge transporting layer 14 having the smallest electrostatic capacity of 270 PF/cm$^2$ among the photosensitive layer 14 to 17 was longer by 2 mm than the width T of the intermediate transfer member 6. That is, both ends of the charge transporting layer 14 project by 1 mm, respectively, from both ends of the intermediate transfer member 6. The other layers have substantially the same length as the width T of the intermediate transfer member 6.

Further, in this Comparative Example, photosensitive drums 10 were prepared in the same manner as in the foregoing Example 1.

The five photosensitive drums 10 prepared by the foregoing method were attached, respectively, to image forming apparatuses shown in FIG. 1 to make 1,000 copies at room temperature and ambient humidity (20° C., 55%), and the images were evaluated. A cycle of 1.0 second was used for the image forming process.

According to this Comparative Example, although the initial images did not suffer occurrence of image blurs, image blurs were produced subsequently (see FIG. 3).

Comparative Example 2

In this Comparative Example, the forming width (forming width along the longitudinal direction of the photosensitive drum 10 ), not of the charge transporting layer 14 having the smallest electrostatic capacity among the photosensitive layers 14 to 17, but of the undercoat layer 16 having an electrostatic capacity of 21,600 PF/cm$^2$, not the smallest, is longer by 4 mm than the width T of the intermediate transfer member 6. That is, both end portions of the undercoat layer 16 are longer by 2 mm, respectively, than the both end portions of the intermediate transfer member 6. The other layers have substantially the same length as the width T of the intermediate transfer member 6.

In this Comparative Example, five photosensitive drums 10 were prepared in the same manner as in the foregoing Example 1.

The thus prepared five photosensitive drums 10 were attached, respectively, to image forming apparatuses shown in FIG. 1 to make 1,000 copies at room temperature and ambient humidity (20° C., 55%), and images were evaluated. A cycle of 1.0 second was used for the image forming process.

According to this Comparative Example, as shown in FIG. 3, same image blurs occurred in the initial images and blurs become more serious thereafter.

Comparative Example 3

In this Comparative Example, the forming width (forming width along the longitudinal direction of the photosensitive drum 10), not of the charge transporting layer 14 having the smallest electrostatic capacity among the photosensitive layers 14 to 17, but of the charge generating layer 15 having an electrostatic capacity of 57,600 PF/cm$^2$, not the smallest, is longer by 4 mm than the width T of the intermediate transfer member 6. That is, the both end portions of the charge generating layer 15 are longer by 2 mm, respectively, than both end portions of the intermediate transfer member 6. The other layers have substantially the same length as the width T of the intermediate transfer member 6.

Further, in this Comparative Example, five photosensitive drums 10 were prepared in the same manner as in the foregoing Example 1.

The five photosensitive drums 10 prepared as alone were attached, respectively, to image forming apparatuses shown in FIG. 1 to make 1,000 copies at room temperature and ambient humidity (20° C., 55%), and images were evaluated. A cycle of 1.0 second was used for the image forming process.

According to this Comparative Example, as shown in FIG. 3, some image blurs occurred in the initial images, and blurs become more serious thereafter.

Example 3

In this Example, while the forming width of the charge transporting layer having the smallest electrostatic capacity among the photosensitive layers 14 to 17 and the forming widths of the other layers are the same as in the Example 1, the constituents of the charge transporting layer are different. The method for preparing a charge transporting layer will be described below.

As in the Example 1, a solution was prepared by dissolving 10 weight parts styryl compound as in the Example 1, and 10 weight parts polycarbonate (weight average molecular weight: 46,000) into a mixed solvent of 20 weight parts dichlormethane and 40 weight parts monochlorbenzene. Polytetrafluoroethylene powder (particle size: 0.2 m) was added to the resultant solution so as to achieve a concentration of 10 wt. % relative to the total solid content and uniformly dispersed throughout the entire solution. The dispersion solution was dip-coated onto the surface of the charge generating layer as in the Example 1, and dried at a temperature of 120° C. for 60 minutes, thereby forming a charge transporting layer having a thickness of 20 $\mu$m. The other layers were prepared in the sa manner as in the Example 1. The ten photosensitive drums 10 thus prepared were evaluated for durability by the use of the same apparatus as in the Example 1 except that the number of copies was changed to 15,000. Simultaneously with this, another tan photosensitive drums prepared in the same manner as in the Example 1 were evaluated. The results are shown in FIG. 3.

When Teflon resin particles were not added to the charge transporting layer, as in clear from FIG. 3, all the initial images were satisfactory. With the number of copies increased to 15,000, however, slight image blurs were observed in two of the ten photosensitive drums prepared as described above. When Teflon resin particles were added, on the other hand, no image blur was observed, not only in the initial images but also even in the 15,000th image.

According to the present invention, as described above, it is possible to prevent occurrence of image blurs even by repeating image transfer onto the intermediate transfer member or formation of a transferred image onto transfer materials.

It is therefore possible to use an organic resin for the photosensitive layer, thus permitting reduction of cost.

What is claimed is:

1. An image forming apparatus comprising:

an image bearing member bearing a toner image, said image bearing member comprising a conductive body and a photosensitive layer, wherein said photosensitive layer comprises a charge transporting layer which transports charge; and an intermediate transfer member having a region in contact relationship with said image bearing member onto which the toner image on said image bearing member is electrostatically transferred from said image bearing member, and the toner image on said intermediate transfer member is transferred onto a transfer material upon contact of said intermediate transfer member with the transfer material, wherein both longitudinal ends of said charge transporting layer project by more than 2 mm, respectively, from both ends of the region.

2. An image forming apparatus according to claim 1, wherein said apparatus further comprises voltage applying means for applying a voltage to said intermediate transfer member so as to electrostatically transfer the toner image on said image bearing member onto said intermediate transfer member.

3. An image forming apparatus according to claim 2, wherein said intermediate transfer member comprises a conductive body, and said voltage applying means applies the voltage to said conductive body of said intermediate transfer member.

4. An image forming apparatus according to claim 3, wherein the voltage is within a range of from 150 to 400 V.

5. An image forming apparatus according to claim 2, wherein said apparatus further comprises latent image forming means which forms a latent image on said image bearing member, and wherein said latent image forming means comprises charging means which charges said image bearing member into a reverse polarity to that of the voltage applied by said voltage applying means.

6. An image forming apparatus according to claim 5, wherein said charging means charges said image bearing member to a voltage within a range of from 350 to 800 V.

7. An image forming apparatus according to claim 1, wherein said charge transporting layer has an electrostatic capacity within a range of from 180 to 600 PF/cm$^2$.

8. An image forming apparatus according to claim 7, wherein said charge transporting layer has a thickness within a range of from 5 to 30 $\mu$m.

9. An image forming apparatus according to claim 8, wherein said charge transporting layer has a thickness within a range of from 5 to 20 $\mu$m.

10. An image forming apparatus according to claim 1, wherein the surface layer of said image bearing member contains fluorine.

11. An image forming apparatus according to claim 1, wherein said intermediate transfer member contains fluorine.

12. An image forming apparatus according to claim 1, wherein said photosensitive layer comprises a charge generating layer which generates charge.

13. An image forming apparatus according to claim 1, wherein, in the longitudinal direction of said image bearing member, the length of said conductive body is longer than that of said photosensitive layer.

14. An image forming apparatus comprising:

an image bearing member bearing a toner image; and an intermediate transfer member having a region in contact relationship with said image bearing member comprising a conductive body, the toner image on said image bearing member being electrostatically transferred from said image bearing member onto said intermediate transfer member, and the toner image on said intermediate transfer member being transferred onto a transfer material upon contact of said intermediate transfer member with the transfer material, wherein said image bearing member comprises a layer having an electrostatic capacity within a range of from 180 to 600 PF/cm$^2$, and both longitudinal ends of said layer project by more than 2 mm, respectively, from both ends of the region.

15. An image forming apparatus according to claim 14, wherein said apparatus further comprises voltage applying means for applying a voltage to said intermediate transfer member so as to electrostatically transfer the toner image on said image bearing member onto said intermediate transfer member.

16. An image forming apparatus according to claim 15, wherein said intermediate transfer member comprises a conductive body, and said voltage applying means applies the voltage to said conductive body of said intermediate transfer member.

17. An image forming apparatus according to claim 16, wherein the voltage is within a range of from 150 to 400 V.

18. An image forming apparatus according to claim 15, wherein said apparatus further comprises latent image forming means which forms a latent image on said image bearing member, and wherein said latent image forming means comprises charging means which charges said image bearing member into a reverse polarity to that of the voltage applied by said voltage applying means.

19. An image forming apparatus according to claim 18, wherein said charging means charges said image bearing member to a voltage within a range of from 350 to 800 V.

20. An image forming apparatus according to claim 14, wherein the surface layer of said image bearing member contains fluorine.

21. An image forming apparatus according to claim 14, wherein said intermediate transfer member contains fluorine.

22. An image forming apparatus according to claim 14, wherein, in the longitudinal direction of said image bearing member, the length of said conductive body is longer than that of said photosensitive layer.

* * * * *

UNITED STATES PATENT AND TRADEMARK OFFICE

CERTIFICATE OF CORRECTION

PATENT NO. : 5,943,541

DATED : August 24, 1999

INVENTOR(S) : SHOJI AMAMIYA ET AL.

It is certified that error appears in the above-identified patent and that said Letters Patent is hereby corrected as shown below:

ON THE COVER PAGE

Abstract, line 7, "the" (first occurrence) should read deleted.

IN THE DRAWINGS

Sheet 5, Figure 5, "GHARGER" should read --CHARGER--.

COLUMN 1

Line 40, "fig" should read --fixing--;
Line 51, "Is" should read --is--; and
Line 67, "Layer" should read --layer--.

COLUMN 2

Line 3, "layer" should read --layer.--; and
Line 19, "discharges." should read --discharge.--.

UNITED STATES PATENT AND TRADEMARK OFFICE

CERTIFICATE OF CORRECTION

PATENT NO. : 5,943,541

DATED : August 24, 1999

INVENTOR(S) : SHOJI AMAMIYA ET AL.

It is certified that error appears in the above-identified patent and that said Letters Patent is hereby corrected as shown below:

COLUMN 4

Line 56, "imidazols," should read --imidazole,--.

COLUMN 5

Line 3, "shape" should read --shape.--.

COLUMN 6

Line 18, "S59-10,950," should read --59-10950,--.

COLUMN 7

Line 49, "PRIOPMMN" should read --PRIOPHEN--; and

Line 51, "2-methaxyethanol," should read --2-methoxyethanol,--.

UNITED STATES PATENT AND TRADEMARK OFFICE

CERTIFICATE OF CORRECTION

PATENT NO. : 5,943,541

DATED : August 24, 1999

INVENTOR(S) : SHOJI AMAMIYA ET AL.

It is certified that error appears in the above-identified patent and that said Letters Patent is hereby corrected as shown below:

COLUMN 8

Line 5, "cyclohexanon," should read --cyclohexanone,--; and

Line 31, "stytyl" should read --styryl--.

COLUMN 10

Line 60, "sa" should read --same--; and

Line 65, "tan" should read --ten--.

COLUMN 11

Line 2, "in" should read --is--.

Signed and Sealed this

Twenty-seventh Day of February, 2001

Attest:

Nicholas P. Godici

NICHOLAS P. GODICI

Attesting Officer

Acting Director of the United States Patent and Trademark Office